US006346157B1

(12) United States Patent
Takezawa et al.

(10) Patent No.: US 6,346,157 B1
(45) Date of Patent: Feb. 12, 2002

(54) MANUFACTURING METHOD OF SUSPENSION SPRING FOR CAR

(75) Inventors: Yoshiyuki Takezawa; Kazuo Ichiki; Naoki Tadakuma, all of Gyoda; Takahiro Tanae; Hiroshi Akiyama, both of Wako, all of (JP)

(73) Assignees: Showa Corp., Saitama; Honda Giken Kogyo Kabushiki Kaisha, Tokyo, both of (JP)

( * ) Notice: Subject to any disclaimer, the term of this patent is extended or adjusted under 35 U.S.C. 154(b) by 0 days.

(21) Appl. No.: 09/538,325

(22) Filed: Mar. 30, 2000

(30) Foreign Application Priority Data

Mar. 31, 1999 (JP) ..... 11-093773
Mar. 17, 2000 (JP) ..... 2000-076275

(51) Int. Cl.[7] ..... C21D 8/00; C21D 7/06
(52) U.S. Cl. ..... 148/580; 148/908; 72/53
(58) Field of Search ..... 148/580, 908; 72/53

(56) References Cited

U.S. PATENT DOCUMENTS 5,665,179 A * 9/1997 Izawa et al. ..... 14/580
6,022,427 A * 2/2000 Wienand et al. ..... 148/908

FOREIGN PATENT DOCUMENTS

JP 3-37434 6/1989
JP 8-41533 7/1994

* cited by examiner

*Primary Examiner*—Deborah Yee
(74) *Attorney, Agent, or Firm*—Merchant & Gould P.C.

(57) ABSTRACT

A method for manufacturing a coiled spring having a high fatigue strength to be used for example as a suspension spring of a car using a rod of tensile strength 1910 to 2020 N/mm$^2$ and diameter 8 to 17 mm. In a cold coiling step, the rod is formed into a coil. Annealing is then carried out to remove strains having arisen inside the coil during the coiling step. A hot setting step of utilizing surplus heat from the annealing step and applying a predetermined load to the coil to compress it for a predetermined time is then carried out. After that, multi-stage shot peening is carried out on the coil.

7 Claims, 4 Drawing Sheets

MANUFACTURING METHOD OF SUSPENSION SPRING FOR CAR

BACKGROUND OF THE INVENTION

1. Field of the Invention

This invention relates to a method for manufacturing a suspension spring used in an automotive vehicle and more particularly to a method for manufacturing a coiled spring having a high fatigue strength.

2. Description of the Prior Art

In coiled springs used as suspension springs in cars, for car body weight reduction, high fatigue strength is being required. In a known method for manufacturing a coiled spring having a high fatigue strength, a high tensile strength rod material made by drawing, quenching and tempering a spring steel rod is used; the rod material is subjected to the steps of coiling, heat-treating, grinding, and shot peening to impart residual stress thereto and then to the step of polishing to reduce surface roughness thereof.

A method for manufacturing a coiled spring is disclosed, for example, in Japanese Patent Laid-Open Publication No. HEI-3-037434. The manufacturing steps of this coiled spring manufacturing method are shown in FIG. 4 hereof and are as follows:

In a cold coiling step ST100, a coil rod is coiled to a predetermined diameter.

In a first low-temperature annealing step ST101, the coil is annealed at a low temperature.

In an end-grinding step ST102, the ends of the coil are ground.

In a shot peening step ST103, the coil is given a compressive residual stress.

In an identification paint coating step ST104, the coil is coated with paint.

In a second low-temperature annealing step ST105, the coil is annealed at a low temperature again.

And in a hot setting step ST106, a predetermined load is applied to the coil for 15 seconds at a temperature of 250° C.

In this coiled spring manufacturing method, to raise the residual compressive stress in the coil by shot peening, it is necessary to increase the particle diameter of the shot, to raise the surface hardness of the shot or to increase the shot speed; however, when this is done, the issue arises that because the surface roughness of the coil increases and consequently stress actually tends to concentrate rather than disperse, the fatigue strength falls.

Another coiled spring manufacturing method is disclosed in Japanese Patent Laid-Open Publication No. HEI-8-41533. This coiled spring manufacturing method is shown in FIG. 5 hereof and is made up of the following steps:

In a step ST110, an oil-tempered steel rod is annealed at a high temperature to obtain an annealed rod.

In a cold coiling step ST111, the annealed rod is coiled by cold working.

In a step ST112, the coiled spring is quenched and tempered.

In a step 113, a seat face (for bearing a compressive load when the coiled spring is compressed) of the coiled spring is ground.

In a step ST114, gas nitriding treatment is carried out on the coiled spring in an ammonia gas atmosphere.

In a step ST115, two-stage shot peening is carried out on the coiled spring:

In a step ST116, a first shot peening of the two-stage shot peening step is carried out. That is, impeller-blasting of cut wire of particle diameter 0.6 to 1.0 mm and Vickers surface hardness 650 to 850 is carried out at a shot speed of 70 to 100 m/s.

In a step ST117, a second shot peening of the two-stage shot peening step is carried out. That is, air-blasting of cut wire or steel balls of particle diameter 0.15 to 0.3 mm and Vickers surface hardness 700 to 900 is carried out at an air pressure of 0.3 to 0.7 MPa.

And in a step ST118, low-temperature annealing is carried out to remove internal strain in the coiled spring.

However, with this coiled spring manufacturing method, although a two-stage shot peening is carried out, by this step alone it is difficult to provide a compressive residual stress from the surface of the coil to deep positions, and it is not possible to raise the fatigue strength sufficiently.

SUMMARY OF THE INVENTION

It is therefore an object of the present invention to provide a manufacturing method for a car suspension spring by which it is possible to manufacture a coiled spring having a high fatigue strength of endurance limit ($\tau m$) 687±588 MPa.

To achieve this object and other objects, the invention provides a method for manufacturing a suspension spring for use in an automotive vehicle, comprising: a cold coiling step of cold forming a rod of tensile strength 1910 to 2020 $N/mm^2$, rod diameter 8 to 17 mm into a coil; a strain-removing step of annealing the coil to remove strains arising in the coil during forming of the coil in the cold coiling step; a hot setting step of compressing the coil by applying a predetermined load thereto at a temperature higher than room temperature and holding that state; and a shot peening step of carrying out a multi-stage shot peening on the coil.

As a result of a hot setting step and a multi-stage shot peening step being combined in this way, in the hot setting step a compressive residual stress is provided in a position deep from the surface of the coil and in the multi-stage shot peening step a higher compressive residual stress is provided in a position near to the coil surface, and a suspension spring having a high fatigue strength is obtained.

In the hot setting step, the coil is compressed with a load at least 10% greater than the maximum in-use load of the coil. For example if a load less than 10% greater than the maximum in-use load of the coil is used, it is not possible to provide satisfactorily a compressive residual stress in a position deep from the coil surface. This hot setting step is carried out utilizing surplus heat from the preceding strain-removing step. When surplus heat is utilized in this way it is not necessary for heating means to be provided separately in the hot setting step, and manufacturing cost can be reduced.

The multi-stage shot peening step preferably includes at least a first stage shot peening wherein steel balls or cut wire of surface Vickers hardness 550 to 650 and particle diameter 0.6 to 1.0 mm are used as a first shot material and the shot speed of the first shot material is 60 to 90 m/s and a second stage shot peening wherein steel balls or cut wire of surface Vickers hardness 600 to 800 and particle diameter 0.15 to 0.3 mm are used as a second shot material and the shot speed of the second shot material is 60 to 90 m/s. That is, the fatigue strength of the coil is raised by a compressive residual stress being provided in the first stage shot peening at relatively deep positions in the vicinity of the coil surface and a compressive residual stress being provided in the second stage shot peening at positions nearer to the coil surface than in the first stage shot peening. Also, by the particle diameter of the shot material used in the second stage shot peening being made smaller than the particle diameter of the shot material used in the first stage shot peening, roughening of the surface of the coil is suppressed and consequent decreasing of the fatigue strength of the coil is prevented.

Preferably, in the first stage of the multi-stage shot peening step the minimum dose of shot material blasted per unit area from the start of the shot peening to the finish is made 180 kg/m$^2$ and in the second stage the minimum shot dose is made 100 kg/m$^2$. For example if the dose of shot material blasted in the first stage shot peening is less than 180 kg/m$^2$, the compressive residual stress arising at positions relatively deep from the surface of the suspension spring becomes small. And if the dose of shot material blasted in the second stage shot peening is less than 100 kg/m$^2$, the residual stress arising at positions near to the surface of the suspension spring becomes small. Either case is undesirable, because the fatigue strength of the suspension spring decreases and it becomes impossible to satisfy predetermined endurance conditions.

BRIEF DESCRIPTION OF THE DRAWINGS

Certain preferred embodiments of the present invention will now be described in detail, by way of example only, with reference to the accompanying drawings, in which.

DETAILED DESCRIPTION OF THE PREFERRED EMBODIMENTS

Figure 1:
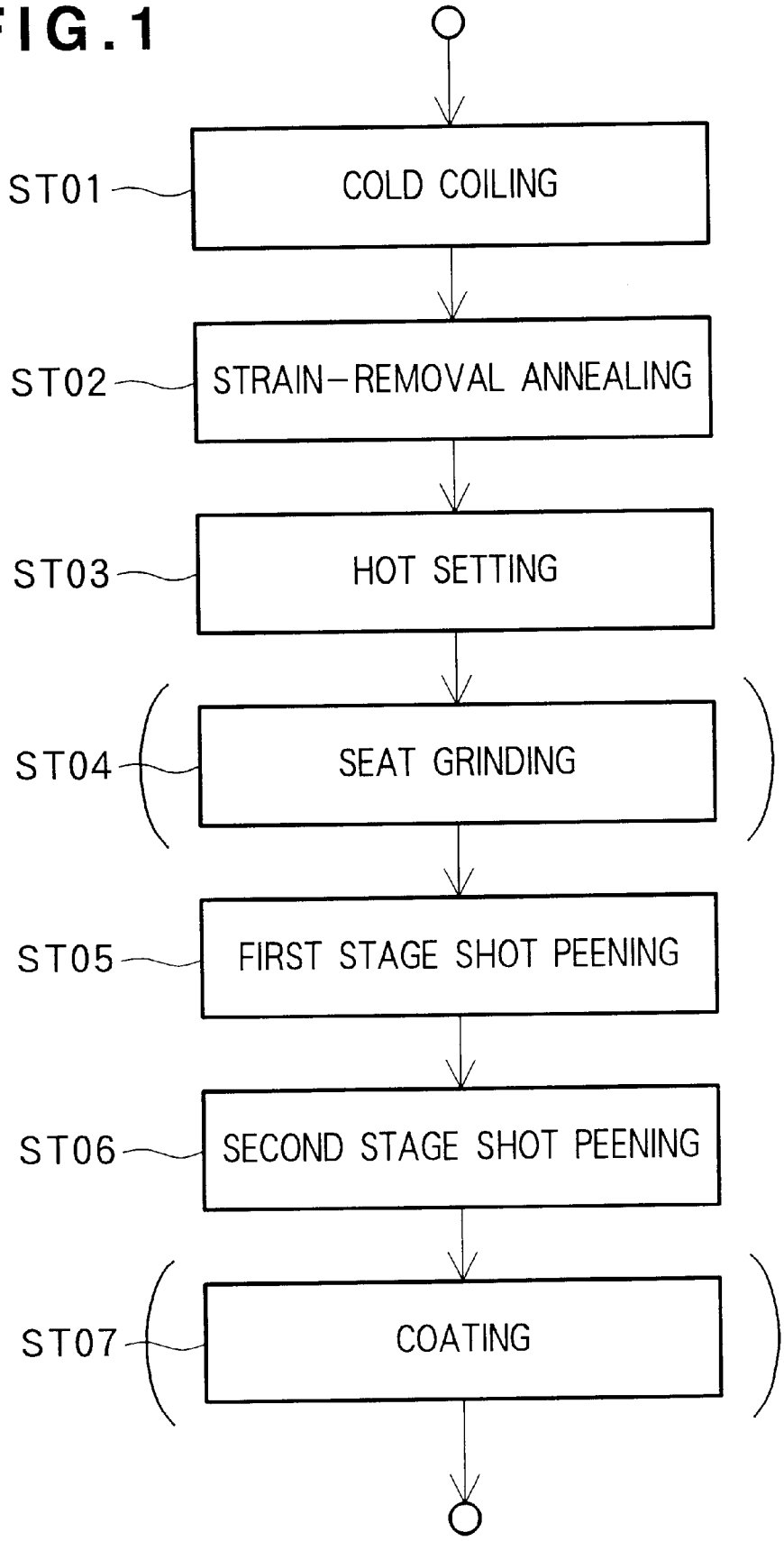
FIG. 1 is a flow chart showing a process according to the invention for manufacturing a coiled spring to be used as a suspension spring of a car.

In FIG. 1, a coiled spring to be used as a suspension spring for a car is manufactured using for example a rod of induction-hardened wire or oil tempered wire stipulated in JIS G 3560 (tensile strength 1910 to 2020 N/mm$^2$, rod diameter 8 to 17 mm).

In a cold coiling step ST01, the rod is formed into a coil by cold working.

In a strain-removing step ST02, to remove strains having arisen inside the coil in step ST01, the coil is annealed for 15 to 30 minutes at a temperature of 350 to 450° C.

In a hot setting step ST03, utilizing surplus heat from step ST02, at a temperature of 200 to 350° C., a load at least 10% greater than the maximum in-use load of the suspension spring is applied to the coil and held for 1 to 2 seconds.

In a step ST04, seat faces of the coil are ground. Depending on the coil, this step may be omitted.

In a step ST05, a first stage shot peening of a multi-stage shot peening step is carried out with the following conditions:

1. Shot Material surface hardness: 550 to 650 HV (Vickers hardness; similarly hereinafter)

particle diameter: 0.6 to 1.0 mm type: steel balls or cut wire

2. Blasting Method impeller (centrifugal blasting)

3. Shot Speed 60 to 90 m/s

4. Shot Dose (minimum dose of shot material blasted per unit area from start to finish of shot peening)

180 kg/m$^2$

In a step ST06, a second stage shot peening of the multi-stage shot peening step is carried out with the following conditions:

1. Shot Material surface hardness: 600 to 800 HV particle diameter: 0. 15 to 0. 3 mm type: steel balls or cut wire 2. Blasting Method impeller (centrifugal blasting)

3. Shot Speed 60 to 90 m/s

4. Shot Dose (minimum dose of shot material blasted per unit area from start to finish of shot peening)

100 kg/m$^2$

In a step ST07, the coil is painted. Depending on the coil, this step may be omitted.

By these steps, the manufacture of a suspension spring for a car is completed.

When a cold coiling step is employed like this, the equipment for heating that is required in the case of hot coiling becomes unnecessary, and it is possible to cut down on capital investment in equipment.

And because surplus heat from the previous step is utilized in the hot setting step ST03, manufacturing cost can be reduced.

Results of a fatigue endurance test carried out with rods of different tensile strengths will now be discussed, with reference to Table 1.

TABLE 1

| | Tensile strength N/mm$^2$ | Surface hardness (Hv) | Rate of breakage on coiling (%) | Endurance test result | Verdict |
|---|---|---|---|---|---|
| Preferred Embodiment 1 | 1910 | 550 | 0 | ○ | ○ |
| Preferred Embodiment 2 | 1960 | 560 | 0 | ○ | ○ |
| Preferred Embodiment 3 | 2020 | 580 | 0 | ○ | ○ |
| Comparison Example 1 | 1900 | — | 0 | x | x |
| Comparison Example 2 | 2100 | 620 | 1.2 | ○ | x |

Table 1 shows results of a fatigue endurance test carried out with rods of different tensile strengths of first through third preferred embodiments and first and second comparison examples.

In the fatigue endurance test, a predetermined repetitive load was applied to the suspension spring to impart a stress amplitude, and when the number of repetitions at which the suspension spring suffered breakage (the endurance count) was above a reference number of repetitions the spring was awarded a verdict of 'O' (OK), and when the number of repetitions at which the suspension spring suffered breakage was less than the reference number of repetitions the spring was awarded a verdict of 'X' (NG).

In these results, 'O' is an endurance count of $30\times10^4$ repetitions or more, and 'X' is an endurance count of less than $30\times10^4$ repetitions.

The specifications of the test samples and the conditions of the shot peening step were as follows:

Spring Specifications wire diameter: 11.6 mm spring coefficient: 38.4 N/mm number of turns in coil: 8.9 diameter: 100 mm free length: 340 mm

First Stage Shot Peening Conditions

Shot Material surface hardness: 580 HV particle diameter: 0.8 mm type: cut wire

Shot Speed 80 m/s

Second Stage Shot Peening Conditions

Shot Material surface hardness: 700 HV particle diameter: 0.2 mm type: steel balls Shot Speed 80 m/s The other steps accorded to the conditions discussed with reference to FIG. 1.

Preferred Embodiment 1 tensile strength 1910 N/mm$^2$, surface hardness 550 HV

Because a rate of breakage during cold coiling was 0% and an endurance test result was O, the verdict is O (OK).

Preferred Embodiment 2 tensile strength 1960 N/mm$^2$, surface hardness 560 HV

Because a rate of breakage during cold coiling was 0% and an endurance test result was O, the verdict is O (OK).

Preferred Embodiment 3 tensile strength 2020 N/mm$^2$, surface hardness 580 HV

Because a rate of breakage during cold coiling was 0% and an endurance test result was O, the verdict is O (OK).

Comparison Example 1 tensile strength 1900 N/mm$^2$

A rate of breakage during cold coiling was 0% but an endurance test result was X. Thus, the verdict is X (NG).

Comparison Example 2 tensile strength 2100 N/mm$^2$, surface hardness 620 HV

Although an endurance test result was O, a rate of breakage during cold coiling was 1.2%. Thus, the verdict is X (NG).

On the basis of the verdicts of the first through third preferred embodiments above, the tensile strength of the rod for manufacturing a suspension spring for a car according to this invention is made 1910 to 2020 N/mm$^2$.

By using multiple samples of each of these first through third preferred embodiments and first and second comparison examples and performing endurance tests at different stress amplitudes on each, from the stress amplitudes and endurance counts a result of 687 (average stress)±588 (stress amplitude) MPa was obtained as the endurance limit of a suspension spring manufactured with a rod of tensile strength 1910 to 2020 N/mm$^2$.

The surface hardnesses shown in Table 1 corresponding to the range of tensile strength of 1910 to 2020 N/mm$^2$ are 550 to 580 HV. If the surface hardness of the shot material of the shot peening used for this is too high with respect to the surface hardness of the coil being shot peened, then the shot material will be damaged, and if it is too low, then a compressive residual stress will not be sufficiently obtained. Accordingly, the lower limit on the surface hardness of the shot material is made 550 HV, while the upper limit is given some allowance and set to 650 HV, which is roughly equal to the surface hardness 620 HV of the coil with the tensile strength of 2100 N/mm$^2$.

The effects of hot setting will now be discussed.

Figure 2:
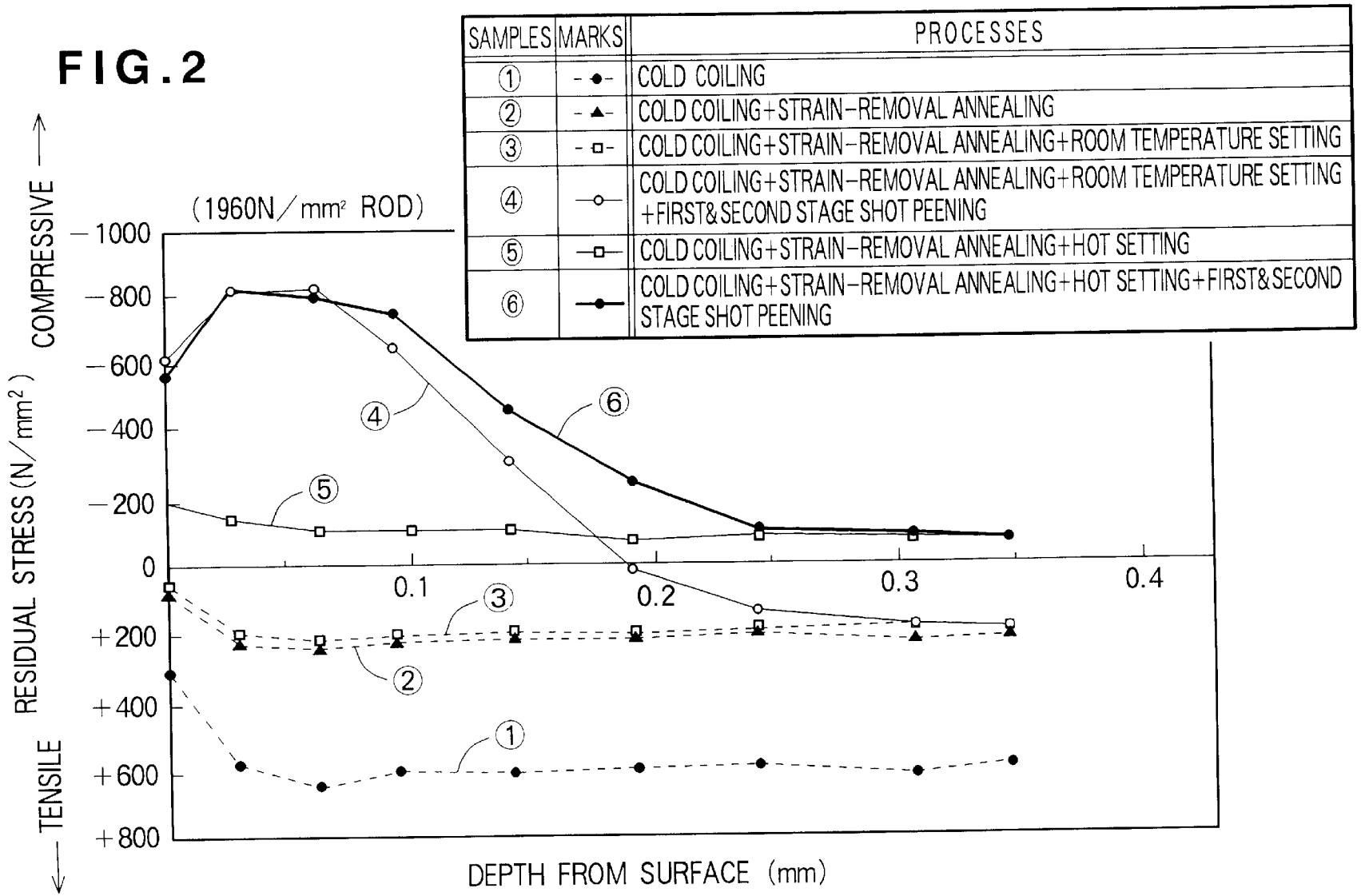
FIG. 2 is a graph illustrating effects of a hot setting step shown in FIG. 1.

FIG. 2 is a graph illustrating effects of hot setting according to the invention, the vertical axis showing residual stress of a suspension spring (for convenience, the upper side of the vertical axis has been made a minus side and the lower side a plus side, so that the upper side shows compressive stress and the lower side tensile stress) and the horizontal axis showing depth from the suspension spring surface. This graph shows residual stress in a suspension spring manufactured from a 1960 N/mm$^2$ rod.

The hot setting conditions were as follows:

setting temperature: 230° C.

setting load: a load 10% greater than the maximum in-use load of the suspension spring setting time: 2 secs The samples in the figure are the following differently processed samples [1] through [6]. The contents of the steps are as described with reference to FIG. 1.

[1] Only cold coiling step carried out.

[2] Cold coiling step→strain-removing step (strain-removal annealing) carried out.

[3] Cold coiling step→strain-removing step (strain-removal annealing)→room temperature setting step (setting step at room temperature) carried out.

[4] Cold coiling step→strain-removing step (strain-removal annealing)→room temperature setting step→first & second stage shot peening step carried out.

[5] Cold coiling step→strain-removing step (strain-removal annealing)→hot setting step carried out.

[6] Cold coiling step→strain-removing step (strain-removal annealing)→hot setting step→first & second stage shot peening step carried out.

In the process of sample [1] a tensile residual stress arose in the coil, and also in the process of [2] and the process of [3], in which room temperature setting was carried out, a small tensile residual stress arose.

In the process of sample [4], wherein a first & second stage shot peening step is added to the process of [3], although a compressive residual stress arose at positions near to the surface of the coil, at positions deep from the surface the compressive residual stress is small, and at positions deeper than about 0.2 mm a tensile residual stress arose.

In the process of [5], which included hot setting, the residual stress is compressive even at positions deep from the coil surface, and in the process of sample [6], wherein a first & second stage shot peening step is added to this process of sample [5], a compressive residual stress arose from positions near the surface of the coil to deep positions.

Here, comparing the process of sample [6], wherein hot setting was carried out, with the process of [4], wherein hot setting was not carried out, it can be seen that with the process of [6] a compressive residual stress arises at positions at a great depth from the suspension spring surface, and in particular even over a range of depth in excess of 0.2 mm from the suspension spring surface.

Thus, by hot setting, besides preventing settling of the suspension spring, it is possible to provide a compressive residual stress from the surface of the suspension spring to a deep position and improve the fatigue strength of the suspension spring.

Next, endurance test results obtained with hot setting and room temperature setting are compared in Table 2.

In these fourth through sixth preferred embodiments the endurance test result is O for tensile strengths of 1910 to 2020 N/mm$^2$, and because when suspension springs are manufactured to within this tensile strength range the hot setting can be carried out with the same conditions for all, manufacturability is also O.

Accordingly, the verdict on each of these fourth through sixth preferred embodiments is O (OK).

TABLE 2

| | Tensile strength N/mm$^2$ | Setting method | Setting load | Endurance test result | Manufactu-rability | Verdict |
|---|---|---|---|---|---|---|
| Preferred Embodiment 4 | 1910 | Hot setting | Maximum in-use load + 10% | ○ | ○ | ○ |
| Preferred Embodiment 5 | 1960 | Hot setting | Maximum in-use load + 10% | ○ | | ○ |
| Preferred Embodiment 6 | 2020 | Hot setting | Maximum in-use load + 10% | ○ | | ○ |
| Preferred Embodiment 7 | 1910 | Hot setting | Maximum in-use load + 30% | ○ | ○ | ○ |
| Preferred Embodiment 8 | 1960 | Hot setting | Maximum in-use load + 30% | ○ | | ○ |
| Preferred Embodiment 9 | 2020 | Hot setting | Maximum in-use load + 30% | ○ | | ○ |
| Comparison Example 3 | 1910 | Room temperature | Maximum in-use load + 10% | x | x | x |
| Comparison Example 4 | 1960 | Room temperature | Maximum in-use load + 10% | x | | x |
| Comparison Example 5 | 2020 | Room temperature | Maximum in-use load + 10% | ○ | | x |
| Comparison Example 6 | 1910 | Hot setting | Maximum in-use load + 5% | x | — | x |
| Comparison Example 7 | 1960 | Hot seting | Maximum in-use load + 5% | x | | x |
| Comparison Example 8 | 2020 | Hot setting | Maximum in-use load + 5% | ○ | | x |

Table 2 shows results of an endurance test carried out with hot setting and room temperature setting compared in fourth through ninth embodiments and third through eighth comparison examples.

As the conditions of the first stage shot peening at this time, cut wire of particle diameter 0.6 mm was used with a shot speed of 60 m/s and a shot dose of shot material of 470 kg/m$^2$, and as the conditions of the second stage shot peening, steel balls of particle diameter 0.15 mm were used with a shot speed of 60 m/s and a shot dose of shot material of 240 kg/m$^2$.

The other steps accorded to the conditions discussed with reference to FIG. 1.

In these results, 'O' is an endurance count of $30\times10^4$ repetitions or more, and 'X' is an endurance count of less than $30\times10^4$ repetitions.

Preferred Embodiment 4 tensile strength 1910 N/mm$^2$, hot setting, setting load 10% greater than maximum in-use load The endurance test result was O.

Preferred Embodiment 5 tensile strength 1960 N/mm$^2$, hot setting, setting load 10% greater than maximum in-use load The endurance test result was O.

Preferred Embodiment 6 tensile strength 2020 N/mm$^2$, hot setting, setting load 10% greater than maximum in-use load The endurance test result was O.

Preferred Embodiment 7 tensile strength 1910 N/mm$^2$, hot setting, setting load 30% greater than maximum in-use load The endurance test result was O.

Preferred Embodiment 8 tensile strength 1960 N/mm$^2$, hot setting, setting load 30% greater than maximum in-use load The endurance test result was O.

Preferred Embodiment 9 tensile strength 2020 N/mm$^2$, hot setting, setting load 30% greater than maximum in-use load The endurance test result was O.

In these seventh through ninth preferred embodiments also the endurance test result is O for tensile strengths of 1910 to 2020 N/mm$^2$, and because when suspension springs are manufactured to within this tensile strength range the hot setting can be carried out with the same conditions for all, manufacturability is also O.

Accordingly, the verdict on each of these seventh through ninth preferred embodiments is also O (OK).

Comparison Example 3 tensile strength 1910 N/mm$^2$, room temperature setting, setting load 10% greater than maximum in-use load The endurance test result was X.

Comparison Example 4 tensile strength 1960 N/mm$^2$, room temperature setting, setting load 10% greater than maximum in-use load The endurance test result was X.

Comparison Example 5 tensile strength 2020 N/mm$^2$, room temperature setting, setting load 10% greater than maximum in-use load The endurance test result was O.

In these third through fifth comparison examples only the endurance test result of the suspension spring manufactured from a rod of tensile strength 2020 N/mm$^2$ was O, and because in manufacturing these suspension springs setting of the tensile strength 1910 N/mm$^2$ spring and the tensile strength 1960 N/mm$^2$ spring would have to be carried out with different conditions from the tensile strength 2020 N/mm$^2$ spring, manufacturability is X.

Accordingly, the verdict on each of these third through fifth comparison examples is X (NG).

Comparison Example 6 tensile strength 1910 N/mm$^2$, hot setting, setting load 5% greater than maximum in-use load The endurance test result was X.

Comparison Example 7 tensile strength 1960 N/mm$^2$, hot setting, setting load 5% greater than maximum in-use load The endurance test result was X.

Comparison Example 8 tensile strength 2020 N/mm$^2$, hot setting, setting load 5% greater than maximum in-use load The endurance test result was O.

In these sixth through eighth comparison examples only the endurance test result of the suspension spring manufactured a from rod of tensile strength 2020 N/mm$^2$ was O, and because in manufacturing these suspension springs setting of the tensile strength 1910 N/mm$^2$ spring and the tensile strength 1960 N/mm$^2$ spring would have to be carried out with different conditions from the tensile strength 2020 N/mm$^2$ spring, manufacturability is X.

Accordingly, the verdict on each of these sixth through eighth comparison examples is also X (NG).

On the basis of these verdicts, the setting load (compression load) of the hot setting step is made at least 10% greater than the maximum in-use load of the suspension spring and preferably in the range of 10% greater to 30% greater than the maximum in-use load of the suspension spring.

Next, endurance test results obtained with different shot doses of shot material in the first stage and second stage shot peenings will be discussed, with reference to Table 3.

TABLE 3

| | Tensile strength | Shot peening shot dose (kg/m$^2$) | | Endurance | |
|---|---|---|---|---|---|
| N/mm$^2$ | 1 stage | 2 stage | | test result | Verdict |
| Preferred Embodiment 10 | 1910 | 470 | 240 | ○ | ○ |
| Preferred Embodiment 11 | 1960 | 470 | 240 | ○ | ○ |
| Preferred Embodiment 12 | 2020 | 470 | 240 | ○ | ○ |
| Preferred Embodiment 13 | 1910 | 200 | 240 | ○ | ○ |
| Preferred Embodiment 14 | 1960 | 200 | 240 | ○ | ○ |

TABLE 3-continued

| | Tensile strength | Shot peening shot dose (kg/m$^2$) | | Endurance | |
|---|---|---|---|---|---|
| N/mm$^2$ | 1 stage | 2 stage | | test result | Verdict |
| Preferred Embodiment 15 | 2020 | 200 | 240 | ○ | ○ |
| Comparison Example 9 | 1910 | 165 | 240 | x | x |
| Comparison Example 10 | 1960 | 165 | 240 | x | x |
| Comparison Example 11 | 2020 | 165 | 240 | ○ | Δ |
| Preferred Embodiment 16 | 1910 | 200 | 120 | ○ | ○ |
| Preferred Embodiment 17 | 1960 | 200 | 120 | ○ | ○ |
| Preferred Embodiment 18 | 2020 | 200 | 120 | ○ | ○ |
| Comparison Example 12 | 1910 | 200 | 80 | x | x |
| Comparison Example 13 | 1960 | 200 | 80 | x | x |
| Comparison Exampe 14 | 2020 | 200 | 80 | x | x |
| Preferred Embodiment 19 | 1910 | 180 | 100 | ○ | ○ |
| Preferred Embodiment 20 | 1960 | 180 | 100 | ○ | ○ |
| Preferred Embodiment 21 | 2020 | 180 | 100 | ○ | ○ |

Table 3 shows results of an endurance test carried out with different shot doses of shot material in the first stage and second stage shot peenings in 10th through 21st preferred embodiments and 9th through 14th comparison examples.

As the conditions of the first stage shot peening at this time, cut wire of particle diameter 0.8 mm was used with a shot speed of 80 m/s, and as the conditions of the second stage shot peening, steel balls of particle diameter 0.2 mm were used with a shot speed of 80 m/s.

The other steps accorded to the conditions discussed with reference to FIG. 1.

Preferred Embodiment 10 tensile strength 1910 N/mm$^2$, first stage shot dose 470 kg/m$^2$, second stage shot dose 240 kg/m$^2$ The endurance test result was O.

Preferred Embodiment 11 tensile strength 1960 N/mm$^2$, first stage shot dose 470 kg/m$^2$, second stage shot dose 240 kg/m$^2$ The endurance test result was O.

Preferred Embodiment 12 tensile strength 2020 N/mm$^2$, first stage shot dose 470 kg/m$^2$, second stage shot dose 240 kg/m$^2$ The endurance test result was O.

Preferred Embodiment 13 tensile strength 910N/mm$^2$, first stage shot dose 200 kg/m$^2$, second stage shot dose 240 kg/m$^2$ The endurance test result was O.

Preferred Embodiment 14 tensile strength 1960 N/mm$^2$, first stage shot dose 200 kg/m$^2$, second stage shot dose 240 kg/m$^2$ The endurance test result was O.

Preferred Embodiment 15 tensile strength 2020 N/mm$^2$, first stage shot dose 200 kg/m$^2$, second stage shot dose 240 kg/m$^2$
The endurance test result was O.

Comparison Example 9 tensile strength 1910 N/mm$^2$, first stage shot dose 165 kg/m$^2$, second stage shot dose 240 kg/m$^2$
The endurance test result was X.

Comparison Example 10 tensile strength 1960 N/mm$^2$, first stage shot dose 165 kg/m$^2$, second stage shot dose 240 kg/m$^2$
The endurance test result was X.

Comparison Example 11 tensile strength 2020 N/mm$^2$, first stage shot dose 165 kg/m$^2$, second stage shot dose 240 kg/m$^2$
The endurance test result was O.

Preferred Embodiment 16 tensile strength 1910 N/mm$^2$, first stage shot dose 200 kg/m$^2$, second stage shot dose 120 kg/m$^2$
The endurance test result was O.

Preferred Embodiment 17 tensile strength 1960 N/mm$^2$, first stage shot dose 200 kg/m$^2$, second stage shot dose 120 kg/m$^2$
The endurance test result was O.

Preferred Embodiment 18 tensile strength 2020 N/mm$^2$, first stage shot dose 200 kg/m$^2$, second stage shot dose 120 kg/m$^2$
The endurance test result was O.

Comparison Example 12 tensile strength 1910 N/mm$^2$, first stage shot dose 200 kg/m$^2$, second stage shot dose 80 kg/m$^2$
The endurance test result was X.

Comparison Example 13 tensile strength 1960 N/mm$^2$, first stage shot dose 200 kg/m$^2$, second stage shot dose 80 kg/m$^2$
The endurance test result was X.

Comparison Example 14 tensile strength 2020 N/mm$^2$, first stage shot dose 200 kg/m$^2$, second stage shot dose 80 kg/m$^2$
The endurance test result was X.

Preferred Embodiment 19 tensile strength 1910 N/mm$^2$, first stage shot dose 180 kg/m$^2$, second stage shot dose 100 kg/m$^2$
The endurance test result was O.

Preferred Embodiment 20 tensile strength 1960 N/mm$^2$, first stage shot dose 180 kg/m$^2$, second stage shot dose 100 kg/m$^2$
The endurance test result was O.

Preferred Embodiment 21 tensile strength 2020 N/mm$^2$, first stage shot dose 180 kg/m2, second stage shot dose 100 kg/m$^2$
The endurance test result was O.

Accordingly, the verdict on the 10th through 21st preferred embodiments is O (OK), while the verdict on the 9th, 10th and 12th through 14th comparison examples is X (NG).

In the 11th comparison example, only the endurance test result of the suspension spring formed from the rod of tensile strength 2020 N/mm$^2$ was O. For manufacturing that suspension spring, it becomes necessary to carry out shot peening under conditions different from those required in manufacturing the suspension springs formed from the rods of tensile strength 1910 N/mm$^2$ or 1960 N/mm$^2$, thereby deteriorating the productivity. Thus, the verdict on the 11th comparison example is Δ (on the borderline).

On the basis of these verdicts, the minimum value of the dose of shot material blasted in the first stage shot peening is made 180 kg/m$^2$, and the minimum value of the dose of shot material blasted in the second stage shot peening is made 100 kg/m$^2$.

Next, the dependency of the residual stress in the suspension spring on the dose of shot material blasted in the first stage and second stage shot peenings will be discussed.

Figure 3:
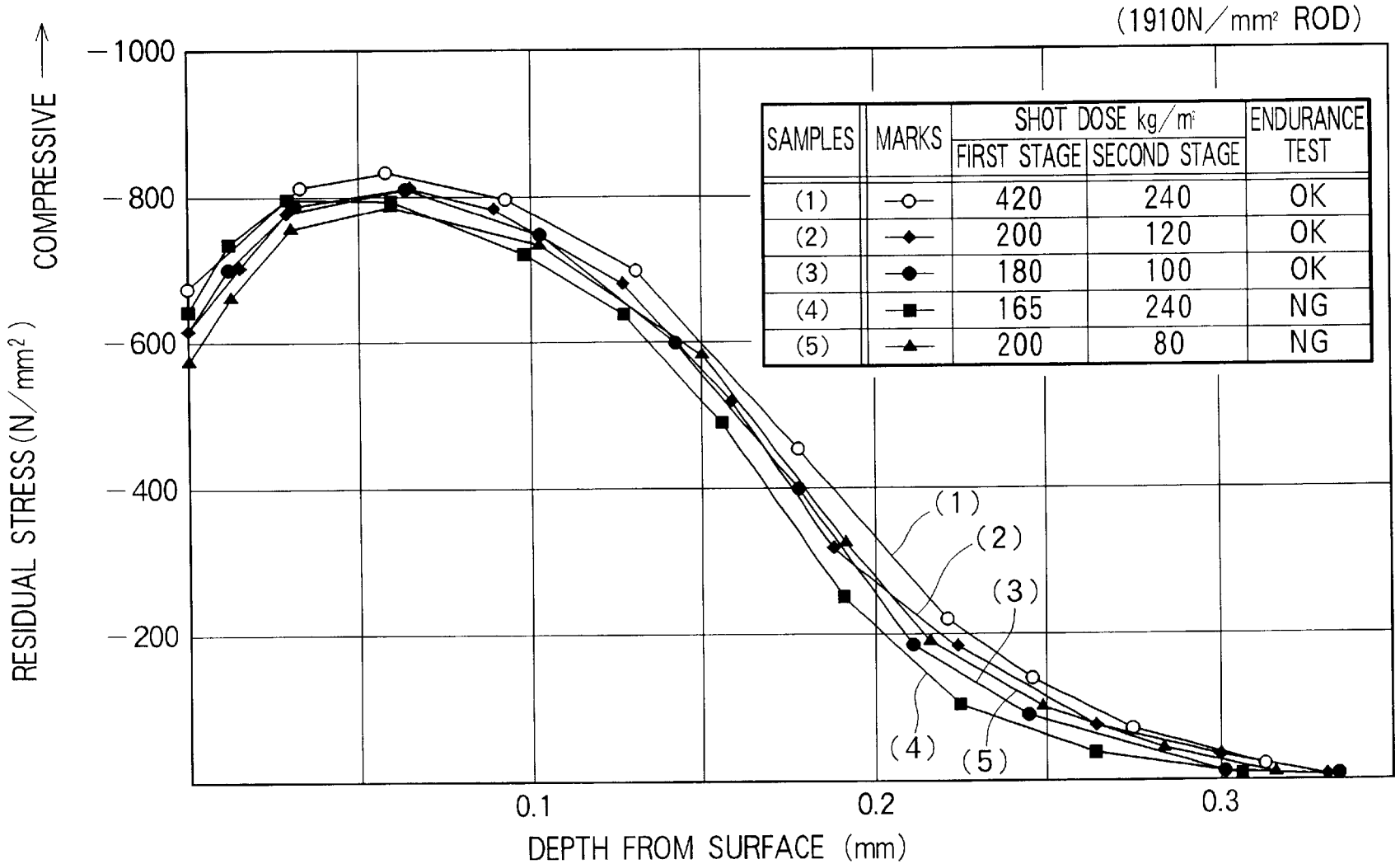
FIG. 3 is a graph illustrating residual stress in a suspension spring for different shot doses of shot material in a shot peening step shown in FIG. 1.
Figure 4:
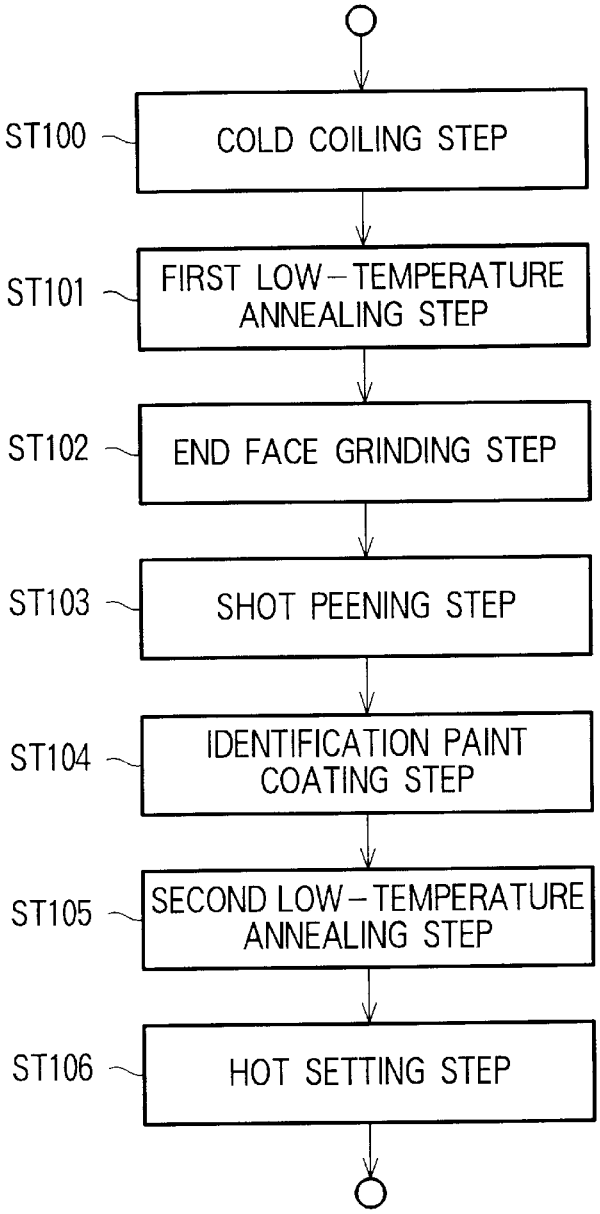
FIG.4 (PRIOR ART)
FIG. 4 is a flow chart showing a first Related Art coiled spring manufacturing process.
Figure 5:
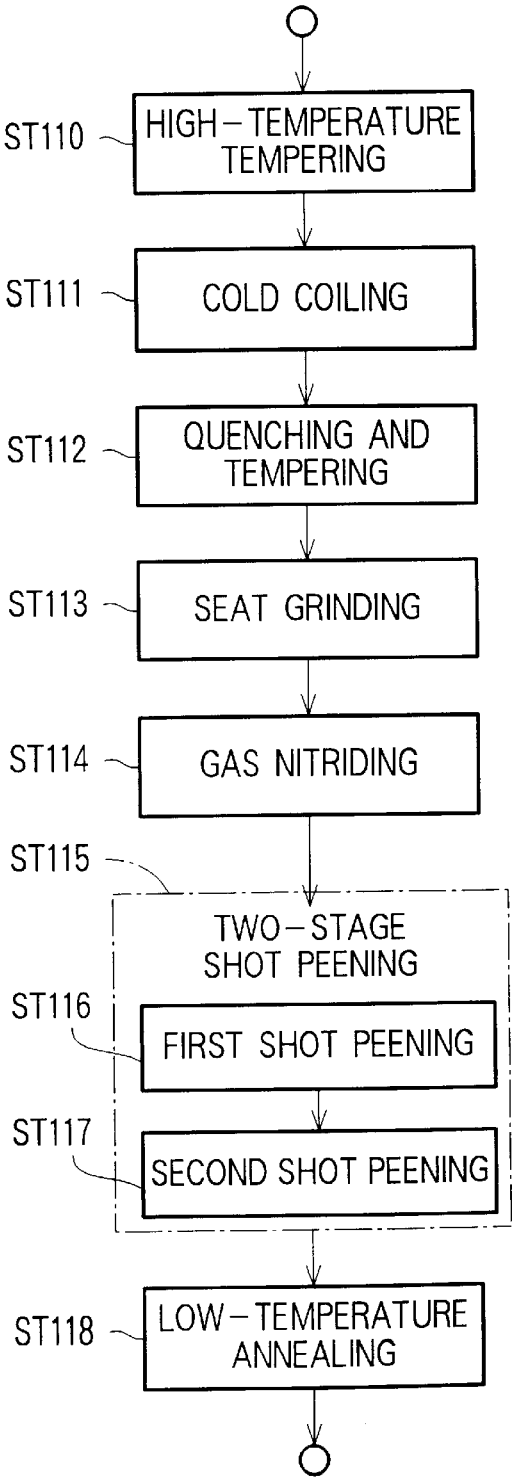
FIG.5 (PRIOR ART)
FIG. 5 is a flow chart showing a second Related Art coiled spring manufacturing process.

FIG. 3 is a graph showing the residual stress in the suspension spring for different doses of shot material blasted in shot peening according to the present invention, the vertical axis showing residual stress in the suspension spring (compressive stress; for convenience, a minus value increasing up the vertical axis) and the horizontal axis showing depth from the suspension spring surface. This graph shows residual stress in a suspension spring manufactured from a 1910 N/mm$^2$ rod.

The shot doses in the samples were: [1] first stage 420 kg/m$^2$, second stage 240 kg/m$^2$; [2] first stage 200 kg/m$^2$, second stage 120 kg/m$^2$; [3] first stage 180 kg/m$^2$, second stage 100 kg/m$^2$; [4] first stage 165 kg/m$^2$, second stage 240 kg/m$^2$; [5] first stage 200 kg/m$^2$, second stage 80 kg/m$^2$.

In sample [1], which has first and second shot doses larger than those of sample [2], the endurance test result was OK. However, an overall residual stress of sample [1] is liable to become undesirably too large. Moreover, increase in the shot doses of sample [1] does not make much difference in its endurance, thereby wasting shot materials, and involves use of a large-sized, expensive shot machine. In this sense, sample [1] is acceptable but does not fall in the "most desired" category.

In sample [4], which has a lower first stage shot dose than samples [2] and [3], the residual stress arising at positions deep from the surface of the suspension spring, i.e. positions deeper than about 0.1 mm, is small, and as shown also in Table 3 the endurance test result was NG.

In sample [5], which has a lower second stage shot dose than sample [2], the residual stress arising at positions near the surface of the suspension spring, i.e. positions less than 0.05 mm deep, was small, and as shown also in Table 3 the endurance test result was NG.

Accordingly, most desired values of the dose of shot materials blasted in the first and second stage shot peening are 180–200 kg/m$^2$ and 100–120 kg/m$^2$, as found in samples [2] and [3].

The rod from which a car suspension spring according to the invention is manufactured does not have to be the oil-tempered wire or induction-hardened wire mentioned in the foregoing description, and may be any wire having a tensile strength of 1910 to 2020 N/mm$^2$.

Also, the number of stages in the multi-stage shot peening step of the invention may be increased in correspondence with an endurance limit, and for example a shot peening with different conditions from the first and second stages may be carried out before the first stage to make a three-stage step, or shot peenings with different conditions from the first and second stages may be carried out before the first stage and after the second stage to make a four-stage step.

What is claimed is:

1. A method for manufacturing a suspension spring used in an automotive vehicle, comprising:

a cold coiling step of cold forming a rod of tensile strength 1910 to 2020 N/mm$^2$, rod diameter 8 to 17 mm into a coil;

a strain-removing step of annealing the coil to remove strains arising in the coil during forming of the coil in the cold coiling step;

a hot setting step of compressing the coil by applying a predetermined load thereto at a temperature higher than room temperature and holding that state; and a shot peening step of carrying out a multi-stage shot peening on the coil.

2. A manufacturing method according to claim 1, wherein in the hot setting step the coil is compressed with a load at least 10% greater than the maximum in-use load of the coil.

3. A manufacturing method according to claim 1, wherein the hot setting step is carried out utilizing surplus heat from the preceding strain-removing step.

4. A manufacturing method according to claim 1, wherein the multi-stage shot peening comprises at least a first stage shot peening wherein steel balls or cut wire of surface Vickers hardness 550 to 650 and particle diameter 0.6 to 1.0 mm are used as a first shot material and the shot speed of the first shot material is 60 to 90 m/s and a second stage shot peening wherein steel balls or cut wire of surface Vickers hardness 600 to 800 and particle diameter 0.15 to 0.3 mm are used as a second shot material and the shot speed of the second shot material is 60 to 90 m/s.

5. A manufacturing method according to claim 1, wherein in the first stage of the multi-stage shot peening the minimum dose of shot material blasted per unit area from the start of the shot peening to the finish is 180 kg/m$^2$ and in the second stage the minimum dose blasted is 100 kg/m$^2$.

6. A manufacturing method according to claim 2, wherein in the first stage of the multi-stage shot peening the minimum dose of shot material blasted per unit area from the start of the shot peening to the finish is 180 kg/m$^2$ and in the second stage the minimum dose blasted is 100 kg/m$^2$.

7. A manufacturing method according to claim 4, wherein in the first stage of the multi-stage shot peening the minimum dose of shot material blasted per unit area from the start of the shot peening to the finish is 180 kg/m$^2$ and in the second stage the minimum dose blasted is 100 kg/m$^2$.

* * * * *